United States Patent [19]

Fumino

[11] Patent Number: 4,923,394

[45] Date of Patent: May 8, 1990

[54] PORTABLE TORCH

[75] Inventor: Ichiro Fumino, Tokyo, Japan

[73] Assignee: Nippon Tansan Gas Co., Ltd., Tokyo, Japan

[21] Appl. No.: 122,249

[22] Filed: Nov. 18, 1987

[30] Foreign Application Priority Data

| | | | |
|---|---|---|---|
| Nov. 19, 1986 | [JP] | Japan | 61-275776 |
| Jul. 29, 1987 | [JP] | Japan | 62-191366 |
| Jul. 29, 1987 | [JP] | Japan | 62-191367 |
| Jul. 29, 1987 | [JP] | Japan | 62-191368 |
| Jul. 29, 1987 | [JP] | Japan | 62-191369 |

[51] Int. Cl.[5] ..... F23D 14/20; F23D 14/46

[52] U.S. Cl. ..... 431/343; 431/344; 431/345; 431/346; 137/505.42; 137/540; 137/614.2; 224/148; 224/252; 220/96; 222/175; 222/465.1; 222/529; 248/121; 294/142; 294/146; 294/167; 294/169

[58] Field of Search ..... 431/344, 346, 343, 345, 431/89; 137/540, 505.42, 614.2, 538; 251/122; 206/45.18; 224/148, 252; 128/205.22; 294/142, 143, 146, 167, 169; 220/96; 222/131, 183, 175, 527, 529, 323, 465.1; 248/96, 121, 155

[56] References Cited

U.S. PATENT DOCUMENTS

| | | | |
|---|---|---|---|
| 1,139,959 | 5/1915 | Fausek | 431/346 |
| 1,512,163 | 10/1924 | Duckett | 220/96 |
| 1,698,156 | 1/1929 | Dorsey | 137/614.2 X |
| 1,865,033 | 6/1932 | Mott et al. | 431/346 X |
| 2,165,342 | 7/1939 | Campbell, Jr. | 222/3 X |
| 2,918,081 | 12/1959 | Lauer, Jr. | 137/505.42 X |
| 3,200,809 | 8/1965 | Suchowolec | 220/96 X |
| 3,878,964 | 4/1975 | Fogle | 294/167 X |
| 3,941,554 | 3/1976 | Curtis | 431/89 |
| 3,972,346 | 8/1976 | Wormser | 137/505.42 |
| 4,062,356 | 12/1977 | Merrifield | 128/205.22 |
| 4,276,902 | 7/1981 | Roth | 137/505.42 X |
| 4,449,698 | 5/1984 | Renato | 266/48 |
| 4,486,044 | 12/1984 | Gordon et al. | 294/142 X |

FOREIGN PATENT DOCUMENTS

| | | | |
|---|---|---|---|
| 137424 | 4/1975 | Japan . | |
| 919209 | 2/1963 | United Kingdom | 431/346 |

*Primary Examiner*—Carl D. Price

*Attorney, Agent, or Firm*—Rodman & Rodman

[57] ABSTRACT

A portable torch including: a gas tank containing therein a combustible gas and another gas tank containing therein a combustion supporting gas; a plurality of pressure regulating mechanisms, in which the primary pressure sides are connected to said gas tanks through plug opening mechanisms, respectively; and a torch portion is connected to the secondary pressure sides of the pressure regulating mechanisms through flexible gas feeding tubes, respectively, provided at the forward end thereof with a jet and having no gas flow rate regulating function. The pressure regulating mechanisms regulate the secondary pressure and gas flow rate from the jet through the secondary pressure. Check valves for blocking the flow of gas from the torch portion to the pressure regulating mechanisms is interposed between the respective pressure regulating mechanisms and the torch portion, to thereby prevent backfire of the flame of the jet.

23 Claims, 5 Drawing Sheets

PORTABLE TORCH

BACKGROUND OF THE INVENTION

1. Field of the Invention

This invention relates to portable torches, and more particularly to an effective technique applied to a portable torch in which a relatively fine and stable flame is required.

2. Related Art Statement

As a portable torch used in applications such as fine soldering and welding works in the chasing, where a working space is small and relatively fine flame is needed, one having the following construction is thought of.

Namely, a combustible gas and a combustion supporting gas are regulated to given values of pressure, respectively, in gas pressure regulating mechanisms mounted onto a combustible gas tank and a combustion supporting gas tank, both of which are small in size, and introduced to a torch through hoses. Control of flow rates, feedings and flow stoppage of both gases to a jet or nozzle provided at the forward end of the torch, is effected by a flow rate regulating mechanism provided in this torch.

Now, in the portable torch having the above-described construction, the pressure regulating mechanism and the flow rate regulating mechanism are provided separately of each other, whereby such a problem is presented that, for example, if the flow rate of the combustible gas and the combustion supporting gas are reduced in the flow rate regulating mechanism provided on the torch, fluctuations in feeding pressure occur in the pressure regulating mechanisms provided at the upstream side, the flow rates of the gases at the jet become unstable, and the fine flame is difficult to stabilize.

Further, in the use, both of gas on-off valves, or the pressure regulating mechanisms, and the flow rate regulating mechanism should be regulated, whereby the operations become complicated. And, the flow rate regulating mechanism is provided on the torch, whereby such a problem is presented that, in the relatively small-sized torch used in a small working space, a knob of the flow rate regulating mechanism interferes with gripping, whereby controllability of the torch is impaired.

Furthermore, as a portable torch having another construction, there is one including a torch body provided thereon with a gas tank and a torch portion where a flame is formed by a gas fed from the gas bomb through a gas pressure regulating mechanism, said torch portion having no gas flow rate regulating mechanism.

However, when a relatively fine flame is formed stably by the latter portable torch, since the torch portion has no gas flow rate regulating mechanism, a gas from a high pressure gas tank should be considerably reduced in gas pressure to be fed to the torch portion.

Since the aforesaid portable torch requires an action of reducing gas pressure to a considerable extent by the gas pressure regulating mechanism as described above, such problems are presented that the gas pressure regulating mechanism should be rendered large in size and high in precision.

SUMMARY OF THE INVENTION

An object of the present invention is to provide a portable torch, in which a fine stable flame can be formed.

Another object of the present invention is to provide a portable torch, in which controllability can be improved.

A further object of the present invention is to provide a portable torch which can be rendered compact in size and simplified in construction.

The portable torch according to the present invention is constructed such that a check valve for obstructing a flow of a gas from the side of a torch portion having no gas flow rate regulating mechanism to the side of a gas pressure regulating mechanism is interposed between the gas pressure regulating mechanism and the torch portion, and the check valve has an additional function of reducing pressure of a gas flowing from the side of the pressure regulating mechanism to the side of the torch portion.

In the aforesaid portable torch according to the present invention, the check valve for obstructing the gas flow from the side of the torch portion to the gas pressure regulating mechanism is interposed between the pressure regulating mechanism and the torch portion, so that a flame formed in the torch portion can be reliably prevented from back-firing to the side of the gas pressure regulating mechanism or the torch body.

Furthermore, the check valve has the additional function of reducing the pressure of the gas flowing from the side of the gas pressure regulating mechanism to the side of the torch portion, whereby the gas fed to the torch portion is reduced in pressure by the check valve in addition to the gas pressure regulating mechanism, so that pressure reducing action by the gas pressure regulating mechanism can be lowered and the gas pressure regulating mechanism can be rendered compact in size and simplified in construction.

BRIEF DESCRIPTION OF THE DRAWINGS

The above and other objects and features of the present invention will become more apparent when referred to the following description given in conjunction with the accompanying drawings, wherein like reference numerals denote like elements, and in which.

DETAILED DESCRIPTION OF THE PREFERRED EMBODIMENTS

Figure 1:
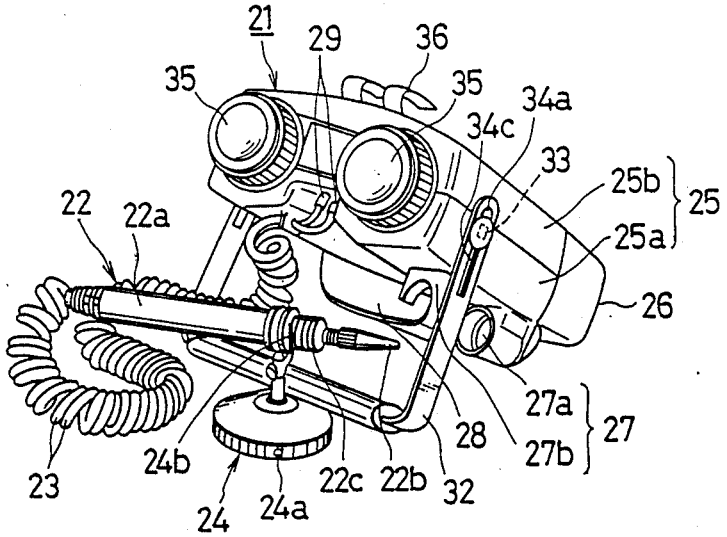
FIG. 1 is a perspective view showing one embodiment of the portable torch according to the present invention.

Referring now to the drawings, a portable torch in one embodiment shown in FIG. 1 includes: a torch body 21; a torch portion 22; a pair of gas feeding tubes 23 for connecting the torch body 21 to the torch portion 22; and a stand 24 for supporting the torch portion 22.

Figure 2:
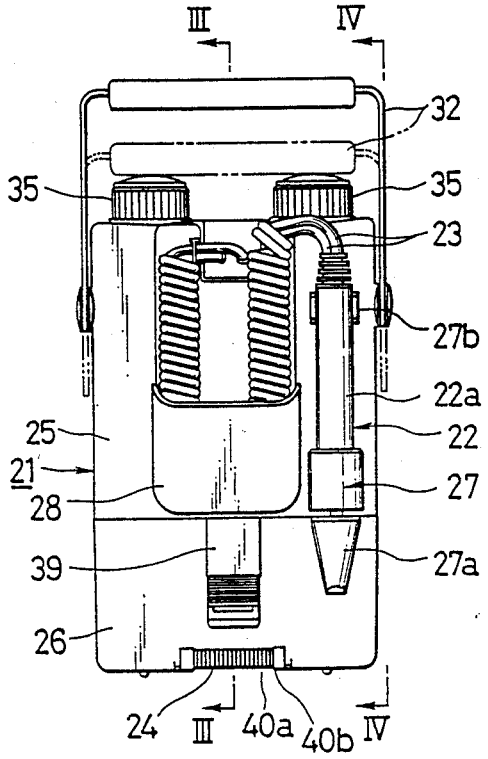
FIG. 2 is a front view showing where the torch portion and tubes are stored in the portable torch.
Figure 3:
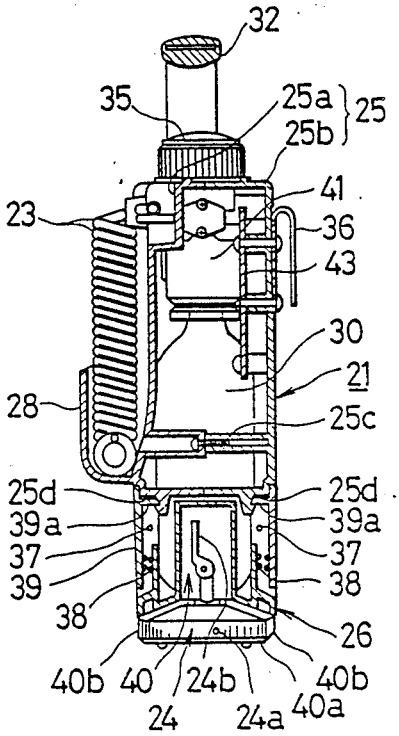
FIG. 3 is a sectional view taken along the line III—III in FIG. 2.

As shown in FIGS. 1 to 3, the torch body 21 includes: a storage case 25, in which a front case member 25*a* and a rear case member 25*b* are connected to each other by a screw 25*c* for example; and a bottom case 26 detachably provided on the lower portion of this storage case 25.

Figure 4:
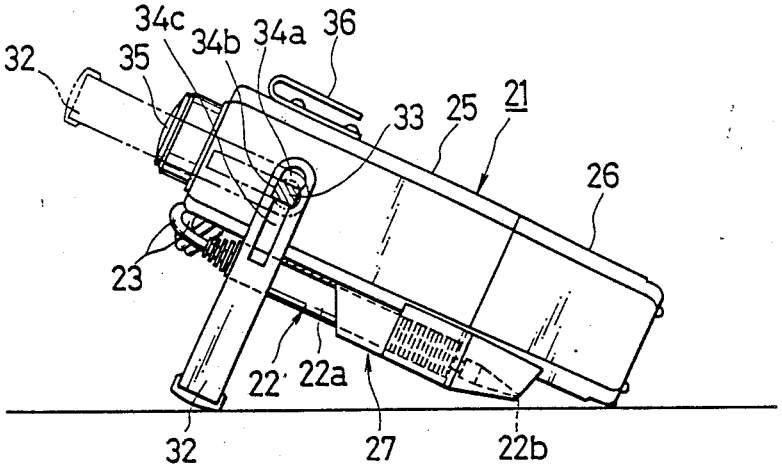
FIG. 4 is a sectional view taken along the line IV—IV in FIG. 2.

Formed at one side of the torch body 21 in a state of being open to the outside, i.e. to atmosphere from the torch body 21 are a torch storage portion 27, in which the torch portion 22 is stored and a tube storage portion 28, in which the tube 23 is stored. The torch storage portion 27 includes: an insertion portion 27*a* being of a tapered tube shape; and an engaging portion 27*b* being of a semicircularly cut-away shape. As shown in FIGS. 2 to 4, the forward end portion of the torch portion 22 is inserted into the insertion portion 27*a* and the rear end portion of the torch portion 22 is engaged with the engaging portion 27*b*, whereby the torch portion 22 is stored.

The tube storage portion 28 is formed into a bag form, and, as shown in FIGS. 2 and 3, the tubes 23 are stored therein in a state where the tubes 23 are folded at the intermediate portions thereof in the tube storage portion 28.

The pair of tubes 23 are integrally connected in parallel to each other, and the tubes 23 in this connected state are spirally extended to be extendable or shrinkable, so that the tubes can be easily and reliably stored in the tube storage portion in a compact state without requiring wind-up and the like when the tubes 23 are stored in the tube storage portion 28. Furthermore, the tubes 23 are fixed to and, directly connected to gas take-out openings 29 protruded to the outside through an outer wall of the front case member 25*a*, so that the tubes 23 cannot be detached from the gas take-out openings 29.

Figure 6:
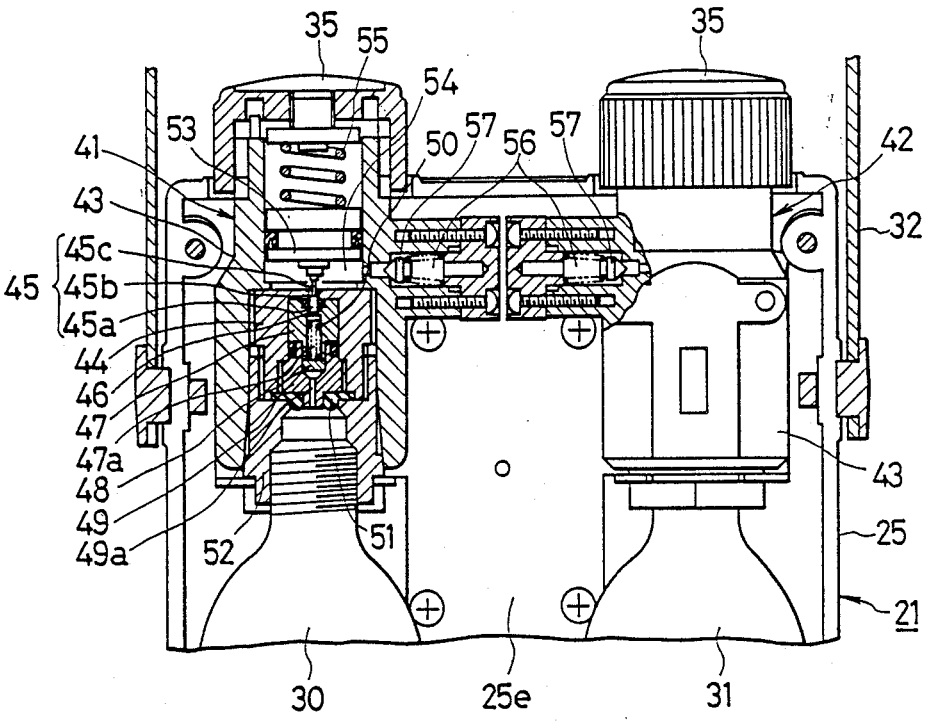
FIG. 6 is a sectional view taken along the line VI—VI in FIG. 5.

In the torch body 21, as shown in FIG. 6, a combustible gas tank 30 having sealed therein combustible gas such for example as a liquefied petroleum gas, and a combustion supporting gas tank 31 having sealed therein a combustion supporting gas such as an oxygen gas are prallelly provided in replaceable states. The pair of tubes 23 are connected to the gas tanks 30 and 31, respectively, whereby the respective combustible gas and combustion supporting gas are led from the respective gas tanks 30 and 31 to the torch portion 22. Fixably and rotatably pivoted on the opposite end portions of the torch body 21 through stems 33 secured to the torch body 21 is a grip portion-support leg portion 32 being of a letter U shape in section. As shown in FIGS. 1 to 4, the torch body 21 can be disposed in an inclined position by use of the grip portion-support leg portion 32. Since the torch body 21 is disposed in an inclined position by use of the grip portion-support leg portion 32, the combustible gas tank 30 can be positioned in an inclined state within a scope where the gas in a gaseous phase as contained in the gas tank 30 can be taken out (an inclined state where the head portion of the combustible gas tank 30 is raised).

The grip portion-support leg portion 32 additionally functions as a grip portion usable when the portable torch is carried by hand and so on. Because of this, as shown in FIG. 4, successively formed on the proximal end portion of the grip portion-support leg portion 32 are a hole 34*a* for rotating the grip portion-support leg portion 32, a hole 34*b* for fixing the grip portion-support leg portion 32 when the torch body 21 is inclinedly positioned, and a hole 34*c* for guiding the grip portion-support leg portion 32 in the longitudinal direction thereof.

The stem 33 being of a rectangular shape in section is inserted through these holes 34*a*, 34*b* and 34*c*, respectively.

Here, the hole 34*a* is formed into a generally circular shape having a diameter equal to a length of a diagonal line of the stem 33, the hole 34*b* is formed into a rectangular shape meeting with the sectional shape of the stem 33, and the hole 34*c* is formed into a slot corresponding to a length of a shorter side of the stem 33.

And, the stem 33 is positioned in the circular hole 34*a*, so that the grip portion-support leg portion 32 can be rotated.

Furthermore, the stem 33 is positioned in the rectangular hole 34*b* when the torch body 21 is inclinedly set as indicated by solid lines in FIG. 4, so that the grip portion-support leg portion 32 can be reliably fixed.

Further, as indicated by two-dot chain lines in FIG. 2 FIG. 4, the stem 33 is positioned in the slot-shaped hole 34*c* and the grip portion-support leg portion 32 is caused to slide toward the proximal end thereof, so that the grip portion-support leg portion 32 can be lowered until the portion 32 comes into abutting contact with a head portion of a pressure regulating dial 35 of the torch body 21.

A belt holder 36 is provided on one side of the torch body 21. This belt holder 36 is used when the torch body 21 is hung on a belt of a user to be held depending upon the purpose of application.

As shown in FIG. 3, in the bottom case 26 of the torch body 21, a detachable hook 39 is provided which is pivoted by stems 37 and biased by a compression spring 38. The bottom case 26 is secured to the storage case 25 in such a manner that an external coupling portion 39*a* of the detachable hook 39 is biased by the spring 38 to be coupled into an internal coupling groove 25*d* of the storage case 25.

Furthermore, the underside of the detachable hook 39 is pushed inwardly against the biasing force of the spring 38 to thereby release the coupling between the external coupling portion 39*a* and the internal coupling groove 25*d*, so that the bottom case 26 can be removed from the storage case 25. By removing the bottom case 26 from the storage case 25, the gas tanks 30 and 31 can be withdrawn from the lower portion of the storage case 25.

A stand storage portion 40 for storing therein the stand 24 is formed in the bottom case 26 and formed on a bottom wall of the bottom portion 26 is a take-out opening 40*a* having a shape generally corresponding to a circular bottom portion of the stand 24 and an engaging projection 24*a* of this bottom portion. Opposite ends of the take-out opening 40*a* are cut away to be a finger grip opening 40*b* for the stand.

In storing the stand 24, the stand 24 is inserted into the storage portion 40 through the take-out opening 40*a*, the engaging projection 24*a* is made to meet a portion of the take-out opening 40*a*, which corresponds to the engaging projection 24*a*, and is inserted, thereafter, the bottom portion of the stand 24 is rotated by finger-gripping through the finger grip opening 40*b*, and the engaging projection 24*a* is engaged with an opening end at the inner side of the take-out opening 40*a*, so that the stand 24 can be stored.

Furthermore, in taking out the stand 24 from the stand storage portion 40, the bottom portion of the stand 24 is finger-gripped though the finger grip opening 40*b* to rotate the bottom portion, and the engaging projection 24*a* is made to meet the portion of the take-out opening 40*a*, which corresponds to the engaging projection 24*a*, and is withdrawn, so that the stand 24 ca be taken out.

As described above, the stand storage portion 40 is constructed such that the stand 24 can be easily mounted to or demounted from the outside of the torch body 21.

Figure 7:
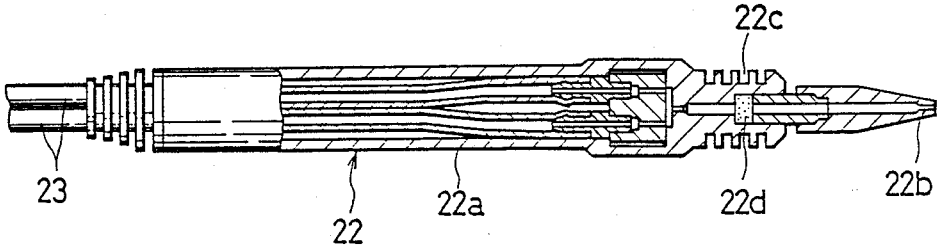
FIG. 7 is a enlarged sectional view showing the torch portion.

As shown in FIGS. 1 and 7, the torch portion 22 is constituted by a grip portion 22*a* and a jet 22*b* detachably, threadably coupled to the forward end portion of this grip portion 22*a*. In the torch portion 22, the combustible gas and combustion supporting gas are mixed together in the grip portion 22*a* and a flame of this mixed gas is formed at the jet 22*b*. This torch portion 22 has a construction having no gas flow rate regulating mechanism.

Formed at the forward end portion of the grip portion 22*a* is an annular groove 22*c*, and, as shown in FIG. 1, the semicircular cut-away support portion 24*b* of the tank 24 is loosely coupled into the annular groove 22*c*, so that the torch portion 22 can be reliably supported.

Furthermore, as shown in FIG. 7, the torch portion 22 has a flame-out filter 22*d* formed of sintered metal, sintered ceramics or the like for example, in a gas flow course close to the jet 22*b*.

As shown in FIG. 6, in the storage case 25, a pair of gas pressure regulating mechanisms 41 and 42 are fixed to a panel 25*e* in parallel disposition.

The gas tanks 30 and 31 are detachably, threadably connected to the primary pressure side of the pressure regulating mechanisms 41 and 42, respectively, and the torch portion 22 is connected to the secondary pressure side of the pressure regulating mechanisms 41 and 42 through the tubes 23 and 23.

Incidentally, in this embodiment, the inner constructions of the pressure regulating mechanisms 41 and 42 are identical with each other, and consequently, the construction of the pressure regulating mechanism 41 will be mainly described in the following description.

In a tubular main body 43 of the pressure regulating mechanism 41, a valve body housing 44 is threadably coupled. A variable diameter valve body 45 penetrates through the valve body housing 44 and protrudes at one end thereof to the secondary pressure side in the axial direction of the valve body housing 44.

The variable diameter valve body 45 includes a large diameter portion 45*a*, a tapered portion 45*b* and a small diameter portion 45*c*. Furthermore, the variable diameter valve body 45 is inserted through a valve seat O-ring 46, which is held by a valve seat guard 47 in the valve body housing 44.

The inner diameter of the valve seat O-ring 46 is smaller than the large diameter portion 45*a* of the varied diameter valve body 45 and larger than the small diameter portion 45*c*.

A flow course 47*a* on the primary side of pressure for guiding the varied diameter valve body 45 in the axial direction thereof penetrates through the valve seat guard 47. A plug opening needle 49 is threadably coupled to the outer end portion of the valve seat guard 47 through a filter 48. A through-hole 49*a* penetrates through this plug opening needle 49 in the axial direction thereof.

In the flow course 47*a* on the primary side of pressure, a valve spring 50 is provided. This valve spring 50 biases the variable diameter valve body 45 to protrude from the valve body housing 44.

Provided around the plug opening needle 49 is a tank threadably coupled thereto with a gas tank 30.

In the pressure regulating mechanism 41 located at a position opposed to the valve body housing 44, an axially movable pressure regulating piston 53 is provided, and a fluid chamber 54 is interposed between the pressure regulating piston 53 and the valve body housing 44.

An end portion of the small diameter portion 45*c* of the varied diameter valve body 45 is biased by a valve spring 50 to be abutted against an end face of the pressure regulating piston 53.

A pressure regulating spring 55 is interposed between the rear surface of the pressure regulating piston 53 and the pressure regulating dial 35.

The pressure regulating dial 35 is threadably coupled to the main body 43 and protruded to the outside of the storage case 25. A displacement of the pressure regulating dial 35, which is generated by rotation of the pressure regulating dial 35 in a desired direction, is imparted to the varied diameter valve body 45 through the pressure regulating spring 55 and the pressure regulating piston 53.

Figure 5:
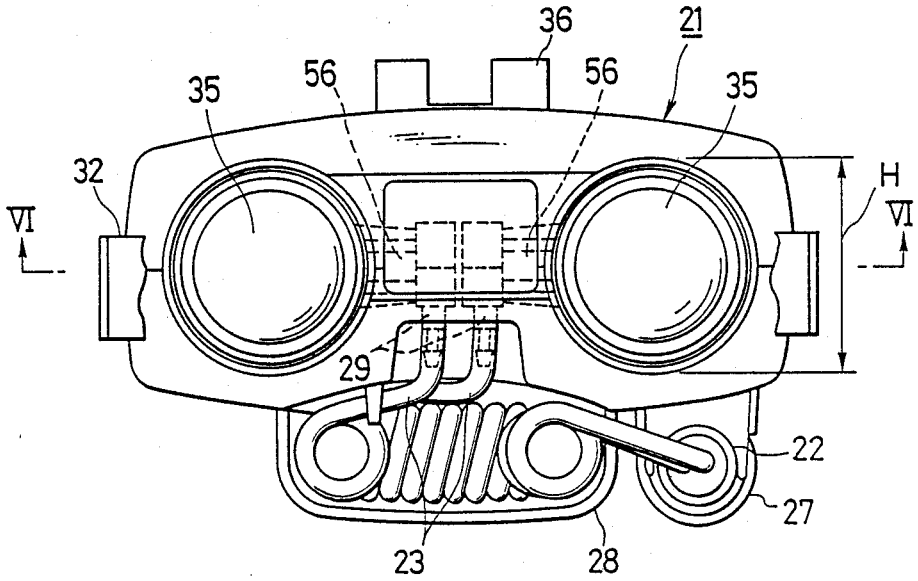
FIG. 5 is an enlarged plan view of the portable torch shown in FIG. 1.

A gas letout 56 extends from the fluid chamber 54 of the pressure regulating mechanism 41 in a direction crossing the axis of the pressure regulating mechanism 41. As shown in FIG. 5, the gas take-out opening 29 is extended from this gas letout 56 in a direction perpendicular to the direction, in which the gas outlet 56 is extended (in FIG. 6, a direction vertical to the paper surface). The gas take-out opening 29 communicates with the pressure regulating mechanism 41 but not through a connecting tube or the like.

And, the gas letout 56 of the pressure regulating mechanism 41 and the other gas letout 56 of the pressure regulating mechanism 42 are opposed to each other, and the gas take out openings 29 and 29 of the respective gas letout 56 and 56 are extended in parallel to each other and directed in the same direction.

In the gas letouts 56 and 56, check valves 57 and 57 are provided, respectively, for blocking the flows of gas from the torch portion 22 to the pressure regulating mechanisms 41 and 42.

The check valves 57 and 57 are each provided with an additional function of reducing the pressure of the gas flowing from the pressure regulating mechanisms 41 and 42 to the torch portion 22 by a given value. Accordingly, the gas fed to the torch portion 22 is also reduced in pressure by these check valves 57 and 57, in addition to the pressure regulating mechanisms 41 and 42.

Action of this embodiment will hereunder be described. In non-use of the portable torch such as during the storage of the portable torch, as shown in FIG. 2, the torch portion 22, the tubes 23 and the stand 24 are stored in the torch storage portion 27, the tube storage portion 40 and the stand storage portion 28, respectively.

In this case, in this embodiment, the torch portion 22 and the tubes 23 are stored respectively in the torch storage portion 27 and the tube storage portion 28, both of which are open to the outside of the torch body 21, i.e. to atmosphere, whereby, even if gas-leaks from the torch portion 22, the tubes 23 and the like, the gas does not stagnate in the torch storage portion 27 and the tube storage portion 28 and is discharged quickly to atmosphere, so that a possibility of dangerous combustion due to the stagnation of the gas can be reliably eliminated.

Furthermore, the gas take-out openings 29 communicate directly with the pressure regulating mechanisms 41 and 42, respectively, and penetrate through the storage case 25 of the torch body 21 to reach to the outside, i.e. to atmosphere, so that reliability against gas leakage can be improved as compared with a construction where piping and the like are provided in the torch body.

Further, the tubes 23 are directly secured to the gas take-out openings 29 and cannot be removed therefrom, whereby a possibility of gas leakage from a connecting portion is eliminated unlike the case where the tubes 23 are detachably connected to the gas takeout openings 29, so that a possibility of dangerous combustion of the gas can be reliably eliminated.

Furthermore, the torch storage portion 27 and the tube storage portion 28 are not provided in the torch body 21, so that the torch body 21 can be rendered compact in size.

Further, the torch storage portion 27 and the tube storage portion 28 are not provided in the torch body 21, whereby the torch storage portion 27 and the tube storage portion 28 can be freely designed without being subject to the calibrations due to the construction of the torch body 21, so that the torch body 21 as a whole can be rendered compact in size.

Furthermore, the stem 33 is positioned in the hole 34*c* of the grip portion-support leg portion 32, whereby the grip portion-support leg portion 32 can be lowered until the portion 32 comes into abutting contact with the pressure regulating dial 35 as indicated by the two-dot chain lines in FIG. 2, so that the height of the portable torch as a whole can be reduced for storage.

On the other hand, when the portable torch is carried by hand, the grip portion-support leg portion 32 is caused to slide to be withdrawn as indicated by the solid lines in FIG. 2, so that the portable torch can be carried with the grip portion-support leg portion 32 being held by hand. Furthermore, a carrier can engage his belt in the belt holder 36 to carry or use the portable torch.

Next, in use of the portable torch, the torch portion 22, the tubes 23 and the stand 24 are taken out of the storage portions 27, 28 and 40, respectively. Furthermore, the stem 33 is positioned in the hole 34*a* shown in FIG. 4, and the grip portion-support leg portion 32 is rotated, thereafter, the stem 33 is positioned in the hole 34*b*, and the grip portion-support leg portion 32 is fixed. And, the torch body 21 is inclined as shown in FIG. 4.

The torch body 21 is set in an inclined position by the grip portion-support leg portion 32, so that the torch body 21 can be in a stable state, with the center of gravity thereof being positioned close to the set surface.

Accordingly, in the portable torch constructed such that the torch body 21 is set, standing in the longitudinal direction thereof, it is necessary to provide a leg portion requiring a large space at the bottom portion of the torch body in order to obtain a stabilized set state. However, in this embodiment, such a leg portion as described above is not necessary, so that the torch body 21 can be rendered compact in size.

Furthermore, when the torch body 21 is set in an inclined position by the grip portion-support leg portion 32, the combustible gas tank 30 can be reliably positioned within the inclined state where the gas in the gaseous phase in the tank 30 can be taken out, so that the gas in the tank 30 can be reliably fed to the torch portion 22.

Here, FIG. 6 shows a state where seal plates, not shown, of the gas tanks 30 and 31 are opened by the plug opening needles 49, respectively, and the gases of relatively high pressure in the gas tanks 30 and 31 flow into the flow course 47*a* on the primary side of pressure through the through-holes 49*a* of the plug opening needles 49 and the filters 48. However, the gas in this flow course 47*a* on the primary side of pressure does not flow into the fluid chamber 54 because the large diameter portion 45*a* of the variable diameter valve body 45 is pressed into and closely attached to the valve seat O-ring 46 to shut the flow course 47*a* on the primary side of pressure off the fluid chamber 54.

In this state the pressure regulating dial 35 is rotatable to a required preset value to displace the varied diameter valve body 45 in a direction of pressing the valve body 45 into the valve body housing 44, through the pressure regulating spring 55 and the pressure regulating piston 53.

Due to this displacement, the state where the large diameter portion 45*a* is closely attached to the valve seat O-ring 46 is released, and the gas in the flow course 47*a* on the primary side of pressure flows out into the fluid chamber 54 through a space formed between the small diameter portion 45*c* and the inner peripheral portion of the valve seat O-ring 46.

In this case, when the gas pressure in the fluid chamber 54 becomes higher than the required preset value of pressure set by the pressure regulating dial 35, the gas pressure pushes up the pressure regulating piston 53 against the biasing force of the pressure regulating spring 55, whereby the large diameter portion 45*a* closes off the inside diameter of the valve seat O-ring 46, so that the flow course 47*a* on the primary side of pressure is shut off from the fluid chamber 54.

On the contrary, when the gas pressure in the fluid chamber 54 becomes lower than the required preset value of pressure set by the pressure regulating dial 35, the pressure regulating piston 53 is pushed down by the biasing force of the pressure regulating spring 55, whereby the closed condition between the large diameter portion 45*a* and the valve seat O-ring 46 is released, so that the gas in the flow course 47*a* on the primary side of pressure flows out into the fluid chamber 54.

As described above, in this embodiment, due to the closed condition between the variable diameter valve body 45 and the valve seat O-ring 46 and the releasing of the closed condition, the required preset value of pressure set by the pressure regulating dial 35 is maintained in the stabilized state, whereby the gas is caused to flow from the jet 22*b* of the torch portion 22 at a predetermined flow rate through this secondary pressure.

Furthermore, the pressure regulating dial 35 is suitably rotated to change the biasing force of the pressure regulating spring 55 on the pressure regulating piston 53, so that the flow rate of gas from the jet 22*b* of the torch portion 22 and the like can be regulated to a desired value in the stabilized state.

Subsequently, the gases which have flowed into the respective fluid chambers 54 as described above are fed to the torch portion 22 through the gas letouts 56, the check valves 57, the gas take-out openings 29 and the tubes 23 and mixed therein, and the mixed gas flows out of the jet 22*b* of the torch portion to form a flame.

In this case, in this embodiment, due to the provision of the check valves 57, even if the combustible gas back-fires from the jet 22*b* through the tubes 23, the check valves 57 are closed due to the rise of internal pressure in the tubes 23, whereby the back fire flame does not intrude into the pressure regulating mechanism 41, to ensure safe operation.

Further, as shown in FIG. 7, the torch portion 22 has the flame-out filter 22*d* formed of sintered metal, sintered ceramics or the like in the gas flow course close to the jet 22*b*, whereby no flame is back-fired into the gas flow course, so that the back fire can be prevented more reliably.

Furthermore, the check valves 57 and 57 in this embodiment have the functions of reducing the pressure of the gases flowing from the pressure regulating mechanisms 41 and 42 to the torch portion 22 by the given values of pressure, so that the gases fed to the torch portion 22 can be reduced by the respective check valves 57 and 57 as well, in addition to the pressure regulating mechanisms 41 and 42. Because of this, the pressure reducing actions performed by the pressure regulating mechanisms 41 and 42 can be relieved as compared with the portable torch having no such check valves 57 as described above, so that the pressure regulating mechanisms 41 and 42 can be rendered compact in size and simplified in construction.

Further, as shown in FIG. 5, in the pressure regulating mechanisms 41 and 42 of this embodiment, the gas letouts 56 and 56 are extended in directions crossing the axes of the pressure regulating mechanisms 41 and 42 and the gas take-out openings 29 and 29 are extended in directions perpendicular to the extended directions of the gas letouts 56 and 56. Furthermore, the gas letouts 56 and 56 are opposed to each other, and the gas take-out openings 29 and 29 are extended in parallel to each other and directed in the same direction.

Because of this, as shown in FIG. 5, the dimensions of the gas outlet 56 and the gas take-out opening 29 can be included within a width H of the pressure regulating mechanisms 41 and 42, and the distance between the pressure regulating mechanisms 41 and 42 can be decreased, so that the general space occupied by the pressure regulating mechanisms 41 and 42 can be reduced. Furthermore, with this construction, the tubes 23 and 23, which are secured to the gas take-out openings 29 and 29, can be centralized.

Incidentally, this embodiment is constructed such that the pressure regulating mechanisms 41 and 42 and the check valves 57 and 57 are adjacent and connected to each other, however, such a construction may be adopted that the pressure regulating mechanisms 41 and 42, and the check valves 57 and 57 are connected to each other through connecting tubes or the like.

Furthermore, in the above embodiment, the torch storage portion 27 and the tube storage portion 28 are provided separately of each other, however, these torch storage portion 27 and tube storage portion 28 may be formed integrally with each other.

Further, the portable torch in the above embodiment is constructed such that the torch portion 22 and the like are provided in addition to the torch body 21 and the grip portion-support leg portion 32, however, the portable torch according to the present invention may adopt such a construction that the portable torch is constituted only by the main body of the portable torch and the leg portion.

Figure 8:
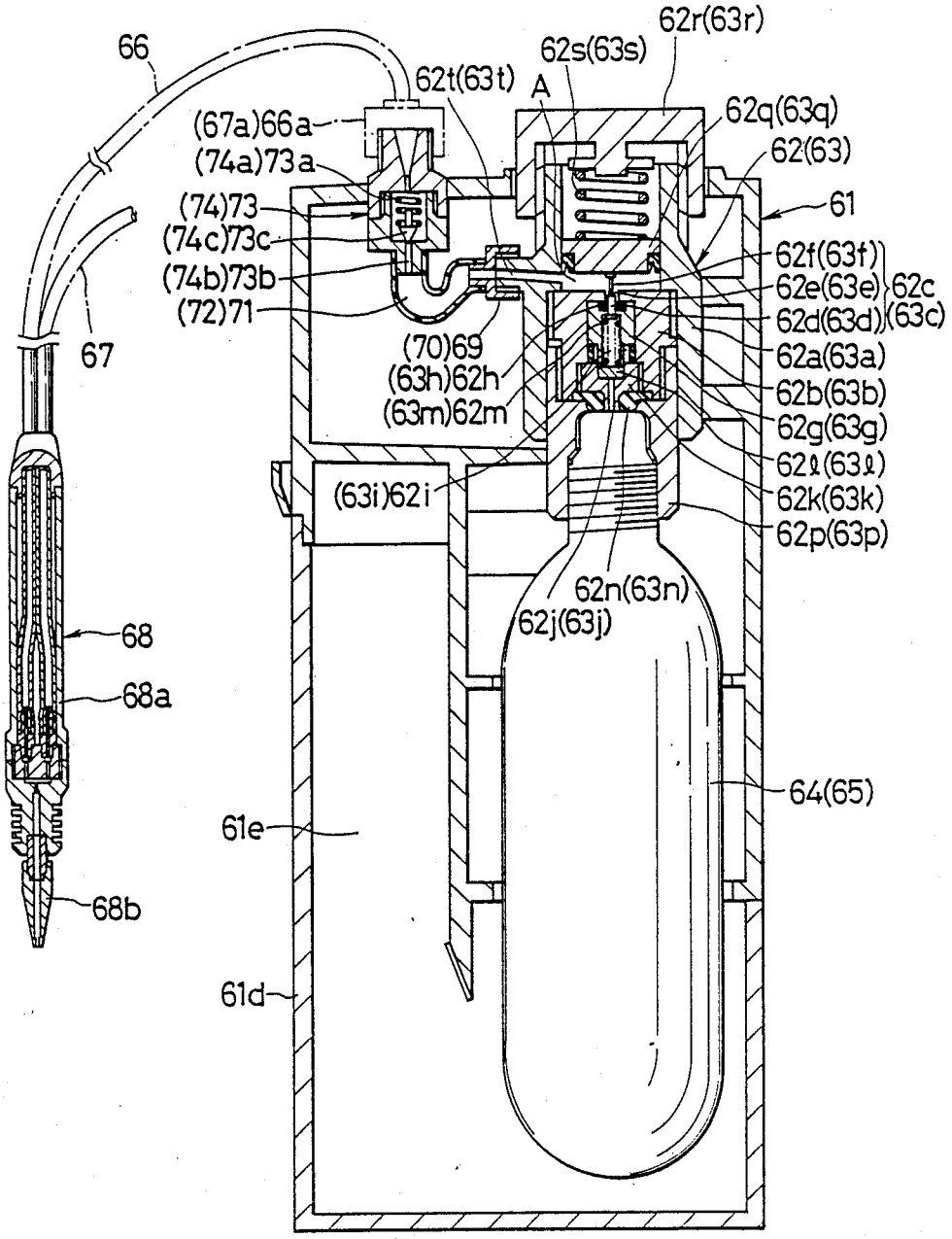
FIG. 8 is a sectional view of the portable torch in another embodiment of the present invention.
Figure 9:
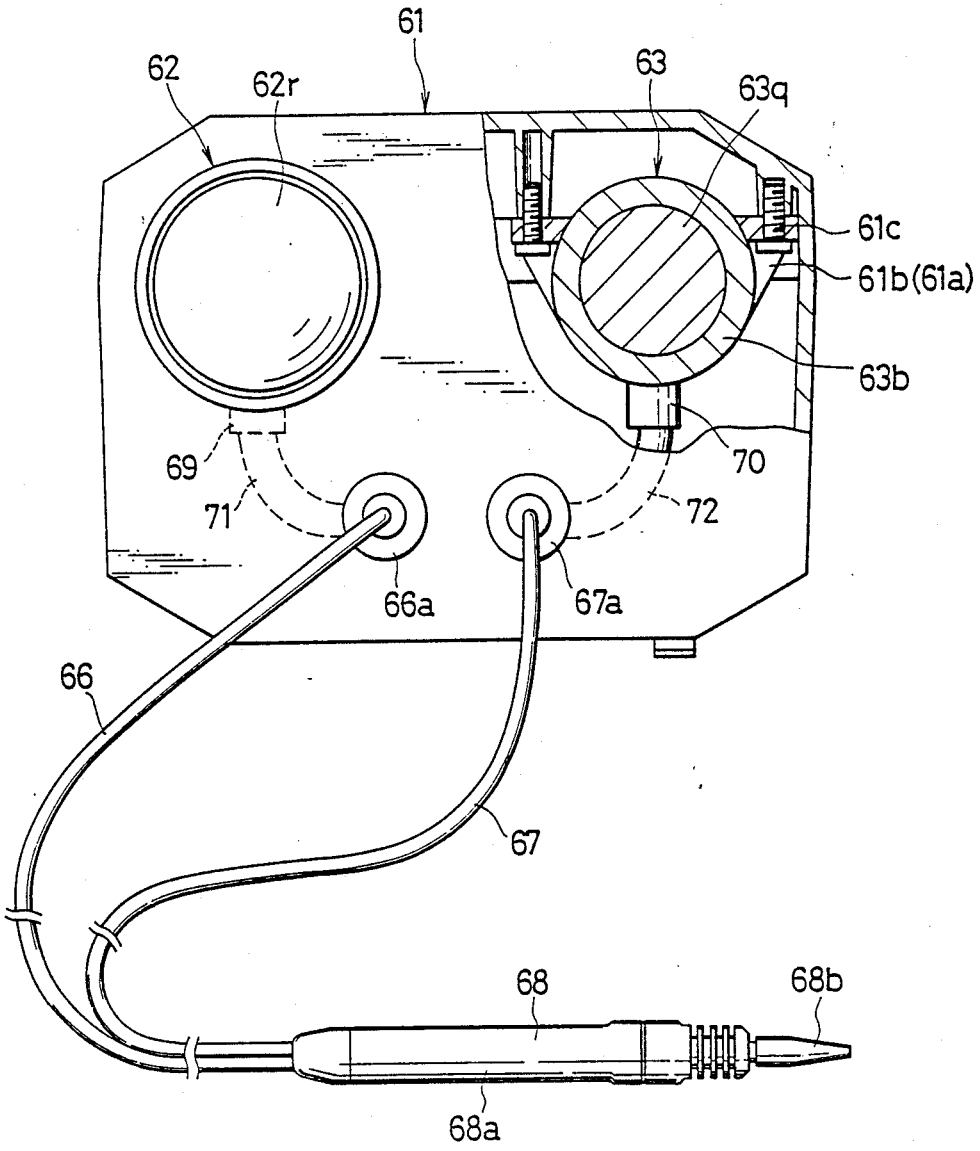
FIG. 9 is a plan view, partially broken away, showing the portable torch illustrated in FIG. 8.

FIG. 8 is the sectional view showing another embodiment of the portable torch according to the present invention. FIG. 9 is the plan view, partially broken away, showing the portable torch illustrated in FIG. 8.

In the portable torch of this embodiment, a pair of spaced and parallel pressure regulating mechanisms 62 and 63 are provided in a storage case 61, and fixed in position by a plurality of brackets 61*a* and 61*b*. and a plurality of locking screws 61*c*, which hold the pressure regulating mechanisms 62 and 63, respectively.

A combustible gas tank 64 having sealed therein the combustible gas such as a liquefied petroleum gas and a combustion supporting gas tank 65 having sealed therein a combustion supporting gas such as oxygen gas are threadably coupled to the primary pressure sides of the pressure regulating mechanisms 62 and 63, to thereby be detachably connected thereto.

Furthermore, a torch portion 68 is connected to the secondary pressure sides of the pressure regulating mechanisms 62 and 63 through flexible tubes 66 and 67 formed independently of each other.

This torch portion 68 is constituted by: a grip portion 68*a*, in which the combustible gas and the combustion supporting gas, which are supplied through the tubes 66 and 67, are mixed; and a jet 68*b* detachably, threadably coupled to the forward end portion of this grip portion 68*a* and having formed at the forward end portion thereof a flame of a mixed gas of the combustible gas and the combustion supporting gas.

Furthermore, a detachable lid member 61*d* is provided at the lower portion of the storage case 61, and releasable when the combustible gas tank 64 and the combustion supporting gas tank 65 are mounted to or demounted from the pressure regulating mechanisms 62 and 63, respectively.

Provided in the lid member 61*d* is a storage portion 61*e*, in which a plurality of tubes 66, 67 and the torch portion 68 are stored when the portable torch is carried by hand.

In this embodiment, the pressure regulating mechanism 62 having mounted thereon the combustible gas tank 64 and the pressure regulating mechanism 63 having mounted thereon the combustion supporting gas tank 65 are identical in inner construction. Thus the construction of the pressure regulating mechanism 62 will mainly be explained in the following description corresponding component parts of the pressure regulating mechanism 63 are indicated be reference numerals in parentheses in FIG. 8.

In a tubular main body 62*a* of the pressure regulating mechanism 62, a valve body housing 62*b* is threadably coupled. A variable diameter valve body 62*c* penetrating through the valve body housing 62*b* and protruding at one end thereof to the secondary pressure side is provided in the valve body housing 62*b* in the axial direction thereof.

The variable diameter valve body 62*c* includes a large diameter portion 62*d*, a tapered portion 62*e* (63e) and a small diameter portion 62*f* in a direction from the primary pressure side to the secondary side of pressure.

Further, the variable diameter valve body 62*c* is inserted through a valve seat O-ring 62*h* held in the valve body housing 62*b* by a valve seat O-ring guard 62*g*.

The inner diameter of this valve seat O-ring 62*h* is smaller than the large diameter portion 62*d* of the variable diameter valve body 62c and larger than the small diameter portion 62f.

A flow course 62i on the primary pressure side for guiding the variable diameter valve body 62c in the axial direction thereof penetrates through the valve seat O-ring guard 62g. A plug opening needle (plug opening mechanism) 62k formed therein with a through-hole 62j in the axial direction thereof is threadably coupled to the outer end portion of the valve seat O-ring guard 62g through a filter 621.

In the flow course 62i on the primary side of pressure, there is provided a valve spring 62m for biasing the variable diameter valve body 62c in a direction of protruding the variable diameter valve body 62c from the valve body housing 62b.

Provided around the plug opening needle 62k is a tank packing 62n, which is fixed by a tank holder 62p threadably coupled thereto with the combustible gas tank 64 (the combustion supporting gas tank 65).

On the other hand, provided at a position opposed to the valve body housing 62b in the pressure regulating mechanism 62 is an axially movable pressure regulating piston 62q. A fluid chamber A (on the secondary pressure side) is interposed between this pressure regulating piston 62q and valve body housing 62b. An end portion of the small diameter portion 62f of the variable diameter valve body 62c is biased by a valve spring 62m to abut against an end face of the pressure regulating piston 62q.

A pressure regulating spring 62s is interposed between the rear surface of the pressure regulating piston 62q and a pressure regulating dial 62r protruding to the outside from the storage case 61 and threadably coupled to the outer end portion of the main body 62a.

An axial displacement of the pressure regulating dial 62r, which is generated by rotation of the pressure regulating dial 62r from the outside in a desired direction, is imparted to the variable diameter valve body 62c through the pressure regulating spring 62s and the pressure regulating piston 62q.

Communicated with the fluid chamber A is a flow course 62t on the secondary pressure side which penetrates through a wall surface of the main body 62a, and threadably coupled to the outer-end portion of this flow course 62t on the secondary side of pressure is a pipe joint 69.

Further, a check valve mechanism 73 engaged with a wall surface of the storage case 61 is connected to the flow course 62t on the secondary pressure side, to which is threadably coupled the pipe joint 69, through a connecting tube 71. Further, connected to this check valve mechanism 73 is a tube 66 to detachably connected through a pipe joint 66a.

Provided in the check valve mechanism 73 is a valve body 73c having a conical forward end portion and being biased by a spring 73a to be normally close an opening portion of a flow course 73b, whereby the combustible gas can flow only in a direction from the flow course 62t on the secondary pressure side to the tube 66.

Action of this embodiment will hereunder be described. It will be noted that the operation of the pressure regulating mechanisms 62 and 63 of the respective tanks 64 and 65 are substantially identical. First, in the state shown in FIG. 8, the large diameter portion 62d of the variable diameter valve body 62c is pressed into and closes the inner peripheral portion of the valve seat O-ring 62h, whereby the flow course 62i on the primary pressure side and the flow course 62t on the secondary pressure side are shut off from each other.

Furthermore, the tubes 66 and 67 of the torch portion 68 are connected to the check valve mechanisms 73 and 74 through pipe joints 66a and 67a, respectively.

In this state, the lid member 61d of the storage case 61 is removed, and the combustible gas tank 64 is threadably coupled and fixed to the tank holder 62p of the pressure regulating mechanism 62.

At this time, a seal plate, not shown, provided on a mounting end of the combustible gas tank 64 is opened by the plug opening needle 62k, gas tightness of a mounting portion of the combustible gas tank 64 to the tank holder 62p is held by the tank packing 62n provided around the lug opening needle 62k, and the combustible gas of relatively high pressure, which is stored in the combustible gas tank 64 is caused to flow into the flow course 62i on the primary pressure side through the through-hole 62j of the plug opening needle 62k and the filter 621. However, at this time, as described above, the large diameter portion 62d of the variable diameter valve body 62c is pressed into and closely attached to the inner peripheral portion of the valve seat O-ring 62h, so that the gas cannot flow into the fluid chamber A on the secondary side of pressure from the flow course 62i on the primary side of pressure.

Subsequently, the pressure regulating dial 62r of the pressure regulating mechanism 62 is rotated to the preset valve to displace the varied diameter valve body 62c in a direction of pressing the valve body 62c into the valve body housing 62b against the biasing force of the valve spring 62m through the pressure regulating spring 62s and the pressure regulating piston 62q. Due to this displacement of the variable diameter valve body 62c, an orifice (space) is formed between the tapered portion 62e, the small diameter portion 62f of the variable diameter valve body 62c and the inner peripheral portion of the valve seat O-ring 62h, and the combustible gas flows through this orifice from the flow course 62i of the primary pressure side to the fluid chamber A which communicates with the flow course 62t on the secondary pressure side.

At this time, when the gas pressure in the fluid chamber A becomes higher than the preset value of pressure set by the pressure regulating dial 62r, the gas pressure pushes up the pressure regulating piston 62q against the biasing force of the pressure regulating spring 62s, whereby the large diameter portion 62d of the varied diameter valve body 62c is pressed into and closes to the valve seat O-ring 62h, so that the flow course 62i on the primary pressure side is shut off from the fluid chamber A.

On the contrary, when the gas pressure in the fluid chamber A becomes lower than the preset value of pressure set by the pressure regulating dial 62r the pressure regulating piston 62q is pushed down by the biasing force of the pressure regulating spring 62s, whereby the closed condition between the large diameter portion 62d and the valve seat O-ring 62h is released, so that the gas in the flow course 62i on the primary pressure side flows out into the fluid chamber A.

Accordingly, in this embodiment, the pressure regulating dial 62r is suitably rotated to change the biasing force of the pressure regulating spring 62s to the pressure regulating piston 62q, so that the flow rate of gas from the jet 68b of the torch portion 68 can be regulated to a given value in the stabilized state.

As described above, the gas which has flowed into each of the fluid chambers A from the tanks 64 and 65, passes through the flow course 62*t* and 63*t*, the connecting tubes 71 and 72, the check valve mechanisms 73 and 74 and the tubes 66 and 67, and flows out from the jet 68*b* of the torch portion 68 at the preset flow rate, to thereby form the desirable fine flame in the stabilized state.

As described above, in this embodiment, setting and regulation of the secondary pressure of the combustible gas, and the combustion supporting gas fed from the combustible gas tank 64 and the combustion supporting gas tank 65 to the torch portion 68 as well as feeding and stopping gas glow to the torch portion 68 are effected by the pressure regulating dial 62*r* provided on the pressure regulating mechanism 62, whereby, when the flow rate of the combustible gas and the combustion supporting gas fed to the torch portion 68 is set to a relatively low value, the feeding pressure of the combustible gas and the combustion supporting gas does not become unstable as in the case where the flow rate regulating mechanisms are provided separately of each other in the torch portion 68 for example, so that a fine stable flame can be formed at the jet 68*b* of the torch portion 68.

Further, setting and regulation of the secondary pressure of the combustible gas and the combustion supporting gas fed to the torch portion 68 as well as feeding and stopping of gas flow to the torch portion 68 are easily effected by rotating only the pressure regulating dial 62*r* and 63*r* of the pressure regulating mechanisms 62 and 63, so that the operation is simplified, no provision of a flow rate regulating mechanism on the torch portion 68 is needed for example, and the degree of freedom of the operation of gripping the torch portion 68 is improved, thus improving control in general.

Furthermore, no provision of the flow rate regulating mechanism on the torch portion 68 is needed, whereby improved reliability due to a reduced number of component parts is realized and the secondary pressure side of the pressure regulating mechanism 62 and 63 are open to the atmosphere, so that improved safety due to restriction of the high pressure portion can be realized.

Further, even if the combustible gas back-fires in the tube 66 in a direction from the torch portion 68 to the pressure regulating mechanism 62, the valve body 73*c* of the check valve mechanism 73 is blocked at once due to increased internal pressure of the tube 66, whereby the backfire flame does not enter the pressure regulating mechanism 62, so that safe operation is assured.

Furthermore, the jet 68*b* of the torch portion 68 is detachably mounted on the grip portion 68*a*, so that the jet 68*b* most suitable for jobs such as soldering and welding can be interchanged.

The present invention ca offer the outstanding functional effects as described below.

(1) The check valve has the additional function of reducing the pressure of gas flowing from the side of the gas pressure regulating mechanism to the side of the torch portion, whereby the gas fed to the torch portion is reduced in pressure by the check valve in addition to the gas pressure regulating mechanism, so that the pressure reducing action performed by the gas pressure regulating mechanism can be reduced, and the gas pressure regulating mechanism can be rendered compact in size and simplified in construction.

(2) The check valve for blocking the flow of gas from the torch portion to the gas pressure regulating mechanism is interposed between the gas pressure regulating mechanism and the torch portion, so that the flame formed in the torch portion can be prevented from back-firing toward the gas pressure regulating mechanism or the torch body.

(3) Due to the effect described in item (1), the torch body can be rendered compact in size and simplified in construction, so that, the controllability, convenience in carrying and storing, and the like of the portable torch of the type described can be improved.

(4) Due to the effect described in item (2), the safety and reliability of the portable torch of the type described can be improved.

(5) The main body of the portable torch is set to an inclined position by the leg portion, so that the main body of the portable torch can be set in the stabilized state where the center of gravity thereof is located at a position close to the set surface.

(6) The main body of the portable torch is set in an position by the leg portion, whereby the vessels for liquefied gases are positioned in an inclination which allows the gases to be taken out of the vessels for liquefied gases, so that the gases in the vessels can reliably flow.

(7) Due to the effect described in item (5), no provision of the leg portion occupying a large space on the main body of the portable torch is needed, so that the main body of the portable torch can be rendered compact in size.

(8) Due to the effect described in item (6), the control in use of the portable torch can be improved.

(9) Due to the effect described in item (7), convenience in operation, carrying, storage and the like of the portable torch can be improved.

(10) The gas take-out openings are extended from the gas outlets opposed to each other, in directions perpendicular to the extended directions of the gas outlets, and one of the gas take-out openings is in generally parallel to the other of the gas take-out openings and directed in the same direction, whereby a large space corresponding to the sum of the gas outlet and the gas take-out openings is not occupied at the outer portion of the outer diameter of the main body of the pressure reducing valve, the dimensions of the gas outlet and the gas take-out opening can be included within the outer diameter of the main body of the pressure reducing valve, and necessity of parallel provisions of the pair of main bodies of the pressure reducing valves with a large interval being formed therebetween is eliminated, so that the space for the pressure reducing valve as a whole can be rendered small.

(11) The pair of gas take-out openings are extended in parallel to each other and directed in the same direction, so that pipings secured to these gas take-out openings can be reliably centralized.

(12) Due to the effects described in item (10) and (11), control of the pressure reducing valves can be improved.

(13) The torch storage portion and the tube storage portion are open to the outside of the torch body, i.e. to atmosphere, whereby, when the torch portion and the tubes for feeding gases are stored in the torch storage portion and the tube storage portion, if gas leakage occurs from the torch portion or the tubes for feeding gases, then the gas does not stagnate in the torch storage portion or the tube storage portion and is released to atmosphere, so that a possibility of the dangerous combustion due to the stagnating gas can be reliably prevented.

(14) The torch storage portion and the tube storage portion are not formed in the torch body, whereby necessity of adopting a construction wherein both the torch portion and the tube for feeding gases are stored is eliminated, so that the torch body can be rendered compact in size.

(15) The torch storage portion and the tube storage portion are not formed in the torch body, so that both storage portions are free from the construction of the torch body, and the torch storage portion and the tube storage portion can be freely formed, and the torch body as a whole can be rendered compact in size.

(16) Due to the effect described in item (13), the reliability of the portable torch of the type described can be improved.

(17) The portable torch including: the plurality of pressure regulating mechanisms, in which the primary pressure sides are connected to the combustible gas tank and the combustion supporting gas tank through plug opening mechanisms, respectively; and a torch portion connected to the secondary pressure sides of the plurality of pressure regulating mechanisms through detachable and flexible tubes, respectively, and provided at the forward end thereof with a jet; is constructed such that:

each of the pressure regulating mechanisms connected to the combustible gas tank and the combustion supporting gas tank includes the variable diameter valve body interposed between the primary and secondary pressure sides, inserted through the valve seat O-ring and biased in the direction of shutting the primary pressure side off from the secondary pressure side by the valve spring and the gas pressure on the primary pressure side, the pressure regulating piston abuts against the end portion of the variable diameter valve body, on the secondary pressure side, for displacing the variable diameter valve body in the direction of canceling the change in gas pressure on the secondary pressure side, and the pressure regulating dial abuts against the rear surface of this pressure regulating piston through the pressure regulating spring; and the displacement of the pressure regulating dial is imparted to the variable diameter valve body through the pressure regulating spring and the pressure regulating piston, whereby there is a shut-off between the primary and secondary pressure sides by a closed condition between the variable diameter valve body and the valve seat O-ring, regulation of the gas pressure on the secondary pressure side by the change in the space formed between the variable diameter valve body and the valve seat O-ring, and regulation of the flow rate from the torch jet, so that operation of the pressure regulating dials provided on the respective pressure regulating mechanisms make it possible to control the flow rate from the jet by regulating the pressures of the combustible gas and the combustion supporting gas fed to the torch portion from the combustible gas tank and the combustion supporting gas tank through the respective pressure regulating mechanisms and so on, thereby enabling to stable feeding of the combustible gas and the combustion supporting gas, both of which have a relative low flow rate, to the torch portion as compared with the case where regulations of the respective gas on-off valves, the gas pressure and the flow rate are performed separately of one another, and permitting formation of a fine, stable flame at the jet of the torch portion.

Furthermore, operations of only the pressure regulating dials make it possible to control the flow rate from the jet by regulating the pressures of the combustible gas and the combustion supporting gas, which are fed to the torch portion and so on and necessity of providing a surplus mechanism interfering with gripping of the torch portion is eliminated, so that control can be improved.

(18) The jet of the torch portion is replaceable, so that the jet most suitable for jobs such as soldering and welding can be interchanged.

(19) The back flow preventing mechanisms are interposed between the secondary pressure sides of the respective pressure regulating mechanisms, which are provided on the combustible gas tank and the combustion supporting gas tank, and the torch portion, whereby, even if the combustible gas back-fires in the tubes in the direction from the torch portion to the pressure regulating mechanisms, the check valve mechanism is blocked at once due to the rise of internal pressure in the tubes, so that the backfire flame does not enter the pressure regulating mechanisms and the like, thus assuring safe operation.

As has been described hereinabove, the present invention has been described in detail with reference to the embodiments, however, the present invention need not necessarily be limited to the above embodiments, and can be modified in various ways within the scope of not departing from the technical gist thereof.

What is claimed is:

1. A portable torch comprising, a first tank containing a combustible gas and a second tank containing a combustion-supporting gas, a first pressure regulating mechanism connected to said first tank and a second pressure regulating mechanism connected to said second tank, each of said first and second pressure regulating mechanisms having a primary pressure side with gas at a primary pressure level, and a secondary pressure side with gas at a secondary pressure level, and an adjustable valve means between the primary and secondary pressure sides for controlling the flow rate of gas from said primary pressure side to said secondary pressure side, the respective primary pressure sides being connected to respective said first and second gas tanks for communication with said adjustable valve means, and a torch portion with flexible tubes for respective connection to the respective secondary pressure sides of said pressure regulating mechanisms, said torch portion having a forward end with a nozzle, and no gas flow regulating devices being provided on said torch portion, first and second check valves respectively interposed between said first and second pressure regulating mechanisms and said torch portion, for blocking backflow of gas from said nozzle portion to respective said first and second pressure regulating mechanisms, said first and second check valves each having the additional function of reducing the pressure of gas flowing from respective said first and second pressure regulating mechanisms to said torch portion, said pressure regulating mechanisms each including means for regulating the gas pressure at said secondary pressure side including first and second manually adjustable pressure regulating dials, respectively corresponding to said first and second gas tanks to regulate the flow rate of gas from respective said first and second gas tanks through said nozzle from respective said secondary pressure sides, whereby each said first and second manually adjustable pressure regulating dial is operable without any other manual control to control the flow rate of gas through said nozzle from respective said ;first and second gas tanks, a housing for said first and second gas tanks and leg means provided on said housing for supporting said housing and said first and second gas tanks in a predetermined inclined position that permits gas to flow outwardly from said gas tanks, said housing including a nonrotatable stem projecting from said housing, and said leg means include a leg portion pivotable with respect to said nonrotatable stem, said leg portion including a first opening engageable with said nonrotatable stem to fix the leg portion in a predetermined angular position with respect to said housing that permits maintenance of said housing in said inclined position, said leg portion further including a slot communicating with said first opening to permit sliding movement of said leg portion with respect to said housing.

2. The portable torch as set forth in claim 1, wherein respective said pressure regulating mechanisms and respective said check valves, are directly connected.

3. The portable torch as set forth in claim 1 wherein said leg portion is in the form of a handle to permit carrying of said housing by said handle.

4. The portable torch as set forth in claim 1 wherein said first and second check valves are respectively joined to each of said first and second pressure regulating mechanisms and include respective gas outlets that are directed opposite to each other, gas outflow openings extending from respective said gas outlets in directions perpendicular to the respective directions of said gas outlets, such that the respective outflow openings are parallel.

5. The portable torch as set forth in claim 4 wherein the adjustable valve means extend in a direction parallel to the direction of the gas outflow openings.

6. The portable torch as set forth in claim 4 wherein the adjustable valve means extends in a direction perpendicular to the direction of the respective gas outflow openings.

7. The portable torch as set forth in claim 1 including a housing for storing said first and second gas tanks, said housing including a torch storage portion for storing said torch portion and a tube storage portion for storing said flexible tubes.

8. The portable torch as set forth in claim 7 wherein said housing has an outside portion and said torch storage portion and said tube storage portion are open at the outside portion of said housing.

9. The portable torch as set forth in claim 7 wherein said first and second flexible tubes are connected to said pressure regulating mechanisms in parallel arrangement and are spirally wound to be extendable.

10. The portable torch as set forth in claim 7 wherein said housing includes gas outflow openings directly communicable with said first and second pressure regulating mechanisms, said flexible tubes are respectively connected to said gas outflow openings and are storable in said tube storage portion in said connected state.

11. The portable torch as set forth in claim 1 wherein said torch portion includes a nozzle that is detachable and interchangeable with other nozzles for said torch portion.

12. The portable torch as set forth in claim 1 where each said pressure regulating mechanism includes a valve seat O-ring, said adjustable valve means including a variable diameter valve body having opposite end portions, said variable diameter valve body being movable through said valve seat O-ring to establish variable gas flow conditions through said O-ring and to engage said O-ring in a closed position to shut off gas flow through said O-ring, first biasing means for biasing said variable diameter valve body in a first direction to shut off gas flow from the primary pressure side to the secondary pressure side, a pressure regulating piston abuttable against one end portion of said variable diameter valve body on the secondary pressure side to move said variable diameter valve body in a second direction opposite said first direction, said manually adjustable pressure regulating dial actuating movement of said pressure regulating piston in said second direction, and a pressure regulating spring interposed between said check valve being directly connected to said pressure regulating mechanism to permit flow from said secondary pressure side through said check valve to said torch portion whereby movement of said pressure regulating dial is imparted to said variable diameter valve body through said pressure regulating spring and said pressure regulating piston to adjust or shut off flow between said primary and said secondary pressure sides of the variable diameter valve body through the valve seat O-ring and through said check valve to said torch portion.

13. A portable torch comprising, a first tank containing a combustible gas and a second tank containing a combustion-supporting gas, a first pressure regulating mechanism connected to said first tank and a second pressure regulating mechanism connected to said second tank, each of said first and second pressure regulating mechanisms having a primary pressure side with gas at a primary pressure level, and a secondary pressure side with gas at a secondary pressure level, and an adjustable valve means between the primary and secondary pressure sides for controlling the flow rate of gas from said primary pressure side to said secondary pressure side, the respective primary pressure sides being connected to respective said first and second gas tanks for communication with said adjustable valve means, and a torch portion with flexible tubes for respective connection to the respective secondary pressure sides of said pressure regulating mechanisms, said torch portion having a forward end with a nozzle, and no gas flow regulating devices being provided on said torch portion, first and second check valves respectively interposed between said first and second pressure regulating mechanisms and said torch portion, for blocking backflow of gas from said nozzle portion to respective said first and second pressure regulating mechanisms, said first and second check valves each having the additional function of reducing the pressure of gas flowing from respective said first and second pressure regulating mechanisms to said torch portion, said pressure regulating mechanisms each including means for regulating the gas pressure at said secondary pressure side including first and second manually adjustable pressure regulating dials respectively corresponding to said first and second gas tanks to regulate the flow rate of gas from respective said first and second gas tanks through said nozzle from respective said secondary pressure sides, whereby each said first and second manually adjustable pressure regulating dial is operable without any other manual control to control the flow rate of gas through said nozzle from respective said first and second gas tanks, a stand for supporting said torch portion, said portable torch further including a housing, said housing including a stand storage portion for storing said stand for said torch portion, said stand being mountable in said stand storage portion or demountable from said stand storage portion for disposition outside said housing.

14. The portable torch as set forth in claim 13 wherein said first and second check valves are respectively joined to each of said first and second pressure regulating mechanisms and include respective gas outlets that are directed opposite to each other, gas outflow openings extending from respective said gas outlets in directions perpendicular to the respective directions of said gas outlets, such that the respective outflow openings are parallel.

15. The portable torch as set forth in claim 14 wherein the adjustable valve means extend in a direction parallel to the direction of the gas outflow openings.

16. The portable torch as set forth in claim 14 wherein the adjustable valve means extends in a direction perpendicular to the direction of the respective gas outflow openings.

17. The portable torch as set forth in claim 13 wherein said housing includes a tank storage portion for storing said first and second gas tanks, a torch storage portion for storing said torch portion and a tube storage portion for storing said flexible tubes.

18. The portable torch as set forth in claim 17 wherein said housing has an outside portion and said torch storage portion and said tube storage portion are open at the outside portion of said housing.

19. The portable torch as set forth in claim 17 wherein said flexible tubes are connected to said first and second pressure regulating mechanisms in parallel arrangement and are spirally wound to be extendable.

20. The portable torch as set forth in claim 17 wherein said housing includes gas outflow openings directly communicable with said first and second pressure regulating mechanisms, said flexible tubes are respectively connected to said gas outflow openings and are storable in said tube storage portion in said connected state.

21. The portable torch as set forth in claim 13 wherein said torch portion includes a nozzle that is detachable and interchangeable with other nozzles for said torch portion.

22. The portable torch as set forth in claim 13 where each said pressure regulating mechanism includes a valve seat O-ring, said adjustable valve means including a variable diameter valve body having opposite end portions, said variable diameter valve body being movable through said valve seat O-ring to establish variable gas flow conditions through said O-ring and to engage said O-ring in a closed position to shut off gas flow through said O-ring, first biasing means for biasing said variable diameter valve body in a first direction to shut off gas flow from the primary pressure side to the secondary pressure side, a pressure regulating piston abuttable against one end portion of said variable diameter valve body on the secondary pressure side to move said variable diameter valve body in a second direction opposite said first direction, said manually adjustable pressure regulating dial actuating movement of said pressure regulating piston in said second direction, and a pressure regulating spring interposed between said check valve being directly connected to said pressure regulating mechanism to permit flow from said secondary pressure side through said check valve to said torch portion whereby movement of said pressure regulating dial is imparted to said variable diameter valve body through said pressure regulating spring and said pressure regulating piston to adjust or shut off flow between said primary and said secondary pressure sides of the variable diameter valve body through the valve seat O-ring and through said check valve to said torch portion.

23. The portable torch as set forth in claim 13, wherein respective said pressure regulating mechanisms and respective said check valves are directly connected.

* * * * *